US006082346A

United States Patent [19]

Andrews et al.

[11] Patent Number: 6,082,346

[45] Date of Patent: Jul. 4, 2000

[54] COMPOUND BOW CAMS AND MODULES

[75] Inventors: Albert A. Andrews, Cleveland, Tenn.; Spencer D. Land, Henderson, Nev.

[73] Assignee: High Country Archery, Inc., Dunlap, Tenn.

[21] Appl. No.: 09/196,035

[22] Filed: Nov. 18, 1998

[51] Int. Cl.[7] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 3,486,495 | 12/1969 | Allen | 124/25.6 |
| 4,515,142 | 5/1985 | Nurney | 124/25.6 |
| 4,519,374 | 5/1985 | Miller | 124/25.6 |
| 4,739,744 | 4/1988 | Nurney | 124/23.1 |
| 5,040,520 | 8/1991 | Nurney | 124/25.6 |
| 5,060,626 | 10/1991 | Elliott et al. | 124/25.6 X |
| 5,390,655 | 2/1995 | Mitchell et al. | 124/25.6 |
| 5,435,292 | 7/1995 | Armstrong | 124/25.6 X |

*Primary Examiner*—John A. Ricci
*Attorney, Agent, or Firm*—Reising, Ethingtion, Barnes, Kisselle, Learman & McCulloch, P.C.

[57] ABSTRACT

A compound bow having a pair of cam modules or secondary cams with at least one cam module having a draw stop integral therewith to engage a harness string of the compound bow at the optimum draw length of the bowstring to prevent this optimum draw length from being exceeded and to efficiently and repeatably store the same quantity of energy in the compound bow. The integral draw stop decreases vibration of the bow in use and cannot be moved to thereby insure that the optimum draw length can be readily achieved throughout the life of the bow. A floor or post is also preferably provided on each cam module to firmly hold and retain one end of a harness string. A track formed in the cam module, which increasingly receives the harness string as a bowstring is drawn, preferably has an inside surface adjacent to a primary cam substantially perpendicular to its axis of rotation and an inclined outside surface spaced from the primary cam providing a track having a width at its outer edge greater than the diameter or width of the harness string to more smoothly receive the harness string within the track to reduce friction between them and thereby reduce string wear and provide an extremely smooth draw of the bowstring.

19 Claims, 3 Drawing Sheets

COMPOUND BOW CAMS AND MODULES

FIELD OF THE INVENTION

This invention relates generally to archery bows, and more particularly to a compound archery bow.

BACKGROUND OF THE INVENTION

Compound bows are well-known and typically have a pair of primary cams with each primary cam disposed at the free end of one of a pair of limbs and around which a bowstring is wrapped under tension. A pair of harness strings may also be interconnected between the free ends of the limbs with one end of each harness string connected to a post extending from a primary cam adjacent one limb and the other end connected to the free end of the other limb. The harness strings are received in tracks formed in cam modules attached to the primary cams when the bowstring is drawn back such as to shoot an arrow. The primary cams and cam modules are contoured such that upon drawing back the bowstring energy is efficiently stored in the deflected or flexed bows limbs. The cams may also be designed to provide a "let off" which reduces the force required to further draw or hold the bow string after a certain draw length has been achieved.

In prior compound bow constructions, the harness strings and the bow string were attached to posts extending from the primary cams which created increased stresses on the primary cams and reduced the efficiency of the bows in use. Further, there were several sources of friction or interference which caused increased wear of the bowstring and harness strings of prior compound bows, such as at the ends of the tracks formed in the primary cams and cam modules and within the tracks themselves. Still further, the tracks formed in the cam modules of these bows are sized to closely receive a portion of a harness string therein. During drawing of the bowstring to load the bow, the harness strings become increasingly engaged with the tracks of the cam modules and, because of the relatively close fit between the harness string and the track increased friction was generated which reduced efficiency of the bow, and caused increased wear on the harness string and an unsteady or "jerky" draw noticeable by the user.

Further, in many compound bow constructions, the optimum draw length for maximum performance and efficiency of the compound bow in use could be exceeded thereby resulting in increased friction, a reduction in the efficiency of the bow, a loss in accuracy of an arrow shot from the bow as well as inconsistent performance of the bow over various draw lengths. To counteract this problem, aftermarket stops could be installed on the cams to engage a harness string or other portion of the compound bow at the desired maximum draw length and thereby prevent a further draw of the bowstring. However, the aftermarket stops must be precisely located on the cam modules to ensure optimum performance of the bow and may cause increased vibration of the bow in use and thereby increase the wear on the bow and its accessories.

Additionally, some prior bows have a cam module attached to a primary cam by only two screws. This is insufficient to accurately locate and fly hold the cams to prevent slight relative movement between them. Thus, some prior bows have a cam module locator stop fixed to or integral with the primary cam to aid in locating the cam module relative to the primary cam by providing a stop surface engageable by the cam module in assembly. This locator stop must be accurately formed on the primary cam and greatly increases the cost to make the primary cam.

SUMMARY OF THE INVENTION

A compound bow is provided having a pair of cam modules with at least one cam module having a draw stop integral therewith to engage a harness string of the compound bow at the optimum draw length of the bowstring to prevent this optimum draw length from being exceeded and to efficiently and repeatably store the same quantity of energy in the compound bow. The integral draw stop will not increase the vibration of the bow in use and cannot be moved to thereby insure that the optimum draw length can be readily achieved throughout the life of the bow. A floor or post is also preferably provided on each cam module to firmly hold and retain one end of a harness string. A track formed in the cam module, which increasingly receives the harness string as a bowstring is drawn, preferably has an inside surface adjacent the cam and an inclined outside surface spaced from the cam providing a track having a width at its outer edge greater than the diameter or width of the harness string to more smoothly receive the harness string within the track to reduce friction between them and thereby reduce string wear and provide an extremely smooth draw of the bowstring.

Preferably, a pair of primary cams are also provided with each having a radiused or arcuate portion at one end of the cam track to reduce wear on the bowstring during use of the bow. Preferably, this radiused portion is disposed at the end of the track where the bowstring leaves the primary cam in the static or at rest position of the compound bow.

Objects, features and advantages of this invention include providing a compound bow with primary cams and cam modules that prevent over-draw of the bow, enable a user to repeatably and efficiently store the same quantity of energy in the drawn bow, provide optimum performance of the bow, reduce wear on the bowstring and the harness strings, reduce stresses on the primary cam and cam modules in use, provide a robust interconnection between the cam modules and the primary cams, increase the rate of speed obtained by an arrow shot from a bow, increase the consistency of the bow's performance, enable more accurate shooting of an arrow from the bow, reduce frictional energy losses, and are of relatively simple design and economical manufacture and assembly, and have a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
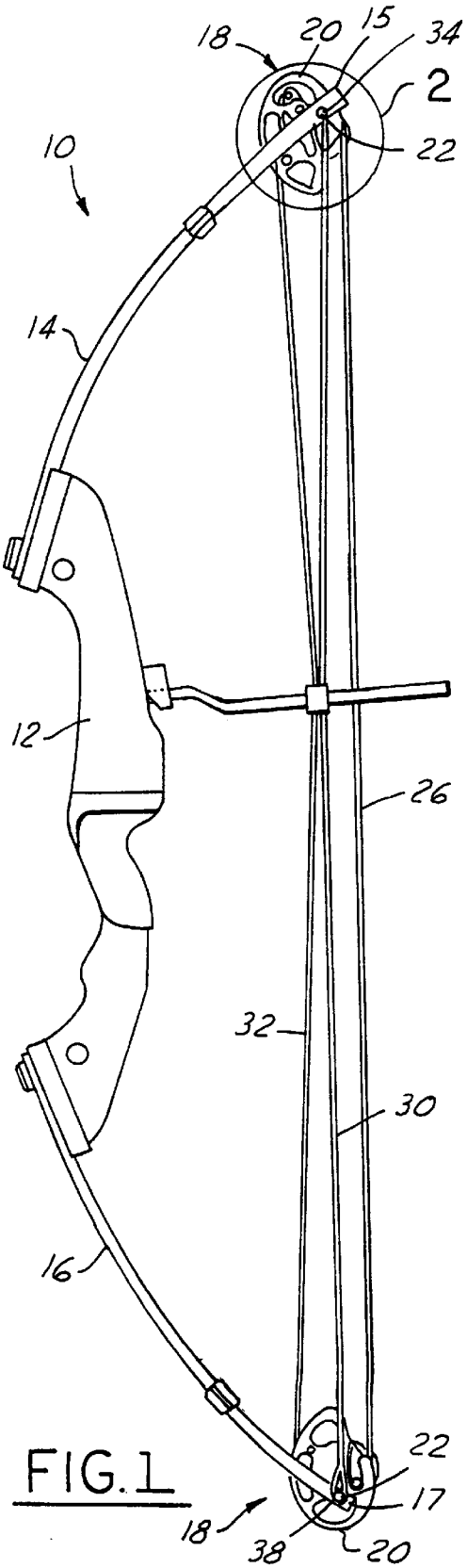
FIG. 1 is a side view of a compound bow embodying the present invention.

Referring in more detail to the drawings, FIG. 1 illustrates a compound bow 10 having a riser 12 with a pair of limbs 14,16 attached to and extending from opposed ends of the riser 12 with a cam assembly 18 carried by each limb 14,16 adjacent to the free end 15,17 of each limb 14,16. As shown in FIG. 8, each limb 14,16 may comprise two separate limb halves 19,21 providing so-called "split limbs" with the cam assemblies 18 received between the limb halves 19,21 adjacent their free ends. Other types of limbs may also be used such as one-piece or solid limbs. As best shown in FIGS. 2–7, each cam assembly 18 has a primary cam 20 eccentrically mounted on an axle 22 carried by the bow limb 14,16 and a secondary cam or cam module 24 operably connected to the primary cam 20. A bowstring 26 has its ends attached to each primary cam 20 and is received in a track 28 formed about the periphery of each primary cam 20. The primary cams 20 are contoured to more efficiently store energy in the bow limbs 14,17 when the bowstring 26 is drawn, to more efficiently release the energy stored in the limbs 14,16 of the drawn bow and to enable the limbs of the bow 10 to be held in the fully drawn position by exerting on the bowstring 26 a draw force less than the maximum draw force necessary to draw the bowstring.

A pair of take-up or harness strings 30,32 are each strung between the free ends of each limb 14,16. Preferably, a harness string 30 is connected at one end to an anchor 34 carried by the axle 22 adjacent the free end of one limb 14 and a post 36 extending from and preferably integral with the cam module 24 adjacent the opposite bow limb 16. Similarly, the other harness string 32 preferably extends between an anchor 38 adjacent the free end of limb 16 and a post 36 preferably integral with the cam module 24 adjacent the opposite limb 14. Preferably, as shown in FIG. 8, an anchor 34 or 38 is carried on each end of each axle 22 and each harness string 30,32 is split at one end providing two independent portions 40,42 each attached to one of the anchors 34 or 38 on the ends of the axle 22 adjacent an end of each limb half 19,21 to more evenly distribute the forces on the limbs 14,16 of the bow 10. As the bowstring 26 is drawn, the bowstring 26 unwraps from the primary cams 20 causing the cam assemblies 18 to rotate in unison but in opposite directions about the axles 22. Simultaneously, the harness strings 30,32 wrap around or increasingly engage tracks 44 formed in the cam modules 24 thus shortening the effective length of the harness strings 30,32 and causing the limbs 14,16 to bend or flex to store energy in the limbs 14,16 of the drawn bow.

As best shown in FIGS. 2, 4, 6 and 7, the primary cams 20 have a recess 48 formed therein and preferably a tear drop shaped post or anchor 50 disposed in this recess and to which a loop 52 of one end of the bowstring 26 is attached. The anchor 50 is preferably integrally formed on the primary cam 20 by removing material to simultaneously form the recess 48 and the anchor 50. Three generally triangularly spaced apart holes 54 through the primary cam 20 receive screws 56 which connect the cam module 24 to a flat inner face 58 of the primary cam 20. A hollow axle hole boss 60 extends from the inner face 58 of the primary cam 20 and preferably has a tubular shaft or bushing 62 press-fit therein to receive the axle 22 about which the cam assemblies 18 rotate.

A radiused or generally arcuate portion 64 is provided on each primary cam 20 where the undrawn bowstring 26 leaves the primary cam 20 in the static or at rest position of the bow 10 (FIG. 1). This radiused portion 64 spans an arc of about between 40° to 70° and has a radius in the range of about 7.5 mm to 28 mm. Desirably, this radiused portion 64 reduces the frictional engagement between the primary cam 20 and the bowstring 26 and permits the primary cam 20 to be rotated farther in its at rest or static position compared to prior bows to more fully engage the bowstring 26 without causing undue wear on the bowstring 26. This improved positioning of the primary cam 20 increases the efficiency of the bow 10 and increases the speed of an arrow shot from the bow 10. The radiused portion also drastically reduces the wear on the bowstring 26 and thereby extends its life in use. The radiused portion 64 is further strategically positioned to avoid disturbing the location or position of the tear drop anchor 50 relative to the center of the axle hole 60 of the primary cam 20 which is critical to the performance of the bow 10 in use. Thus, with proper positioning of this radiused portion 64 the life of the bowstring 26 can be increased without degradation of the performance of the bow 10 in use.

The secondary cams or cam modules 24 have a profile similar to that of the primary cams 20 to facilitate smoothly engaging the harness strings 30,32 at a rate similar to the unwinding of the bowstring 26 from the primary cam track 28. Each cam module 24 has a hooked end 70 (FIG. 5) which is received over the axle hole boss 60 of the primary cam 20. A loop 72 at one end of a harness string 30 or 32 is received over a harness string hook-up post 36 extending from and preferably integral with the cam module 24 to retain the end of the harness string 30 or 32. To more securely hold and retain the loop 72 of the harness string on the post 36, the post 36 may have a circumferentially continuous groove 74 formed in its side. As best shown in shown FIG. 6 when the harness strings 30,32 are hooked to their posts 36, they are generally aligned with the tracks 44 formed in the cam modules 24 for increasing engagement with the cam modules 24 as the cam assemblies 18 are rotated.

Figure 9:
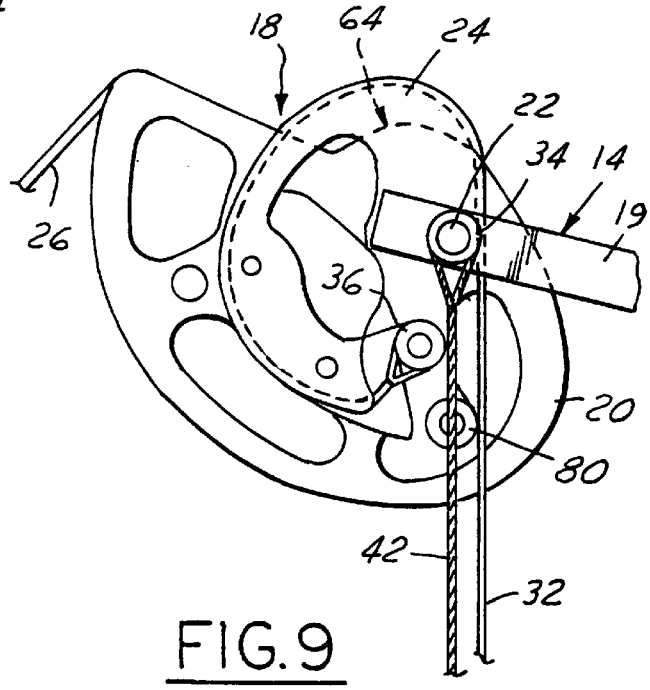
FIG. 9 is a fragmentary side view of a cam assembly of the bow of FIG. 1 in its fully drawn position.

A draw stop 80 is also provided on at least one of the cam modules 24 and is constructed to bear on or abut an adjacent harness string 30,32 when an optimum, fully drawn position of the bowstring 26 is achieved as shown in FIG. 9. The draw stop 80 is integrally formed with the cam module 24 and preferably comprises a generally smooth, round knob or post extending from the cam module 24. Preferably, a draw stop is provided on each cam module 24 with each draw strop 80 positioned so that both generally simultaneously engage the harness string 30,32 connected to the post 36 of the same cam module 24 at the optimum, fully drawn position of the bow 10. More specifically, the draw stop 80 of the cam assembly 18 connected to limb 14 engages harness string 32 and the draw stop 80 of the cam assembly 18 connected to limb 16 is constructed to simultaneously engage harness string 30. The position of the draw stops 80 determines the maximum draw length of the bow 10 and prevents drawing the bowstring 26 beyond the optimum or preferred draw length which results in the loss of potential energy stored in the bow, an increase in friction, a reduced speed of an arrow shot from the bow, and an inconsistent flight path of arrows shot from the bow. Thus, with the draw stops 80 strategically located on the cam modules 24, a user can efficiently and repeatably store the same quantity of energy in the bow 10 by drawing the bowstring 26 from its at rest or static position (FIG. 1) to the optimum fully drawn position (FIG. 9) limited by the engagement of the draw stops 80 with the harness strings 30,32. The distance from the center of the axle boss 60 to the center line of the draw stop 80 is preferably between about 0.5 inches and 1.5 inches and desirably between 0.69 inches and 1.23 inches.

Figure 2:
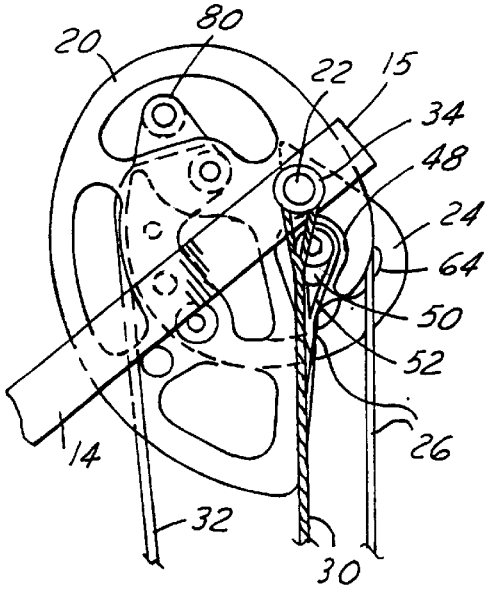
FIG. 2 is a fragmentary side view per the encircled portion 2 of FIG. 1.
Figure 3:
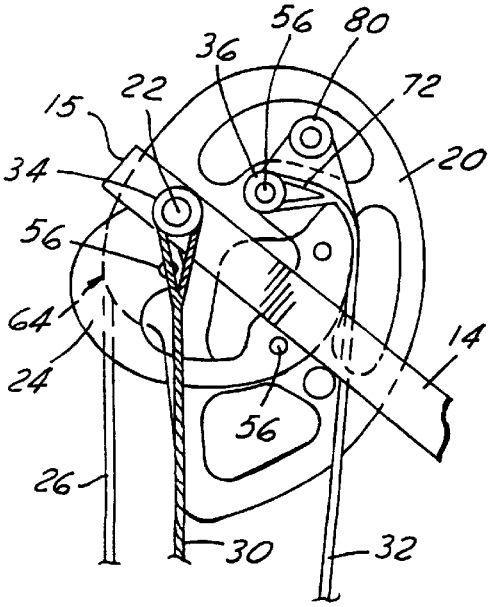
FIG. 3 is a fragmentary side view per the encircled portion 2 of FIG. 1 and illustrating the opposite side from the side in FIG. 2.
Figure 4:
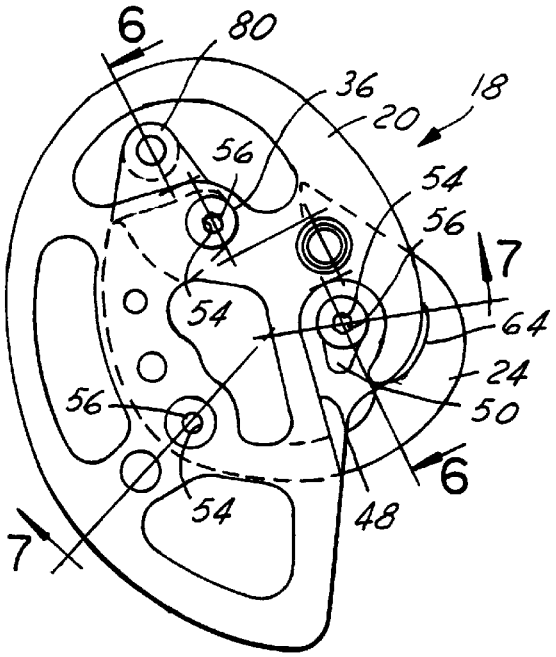
FIG. 4 is a side view of a cam assembly of the bow of FIG. 1.
Figure 5:
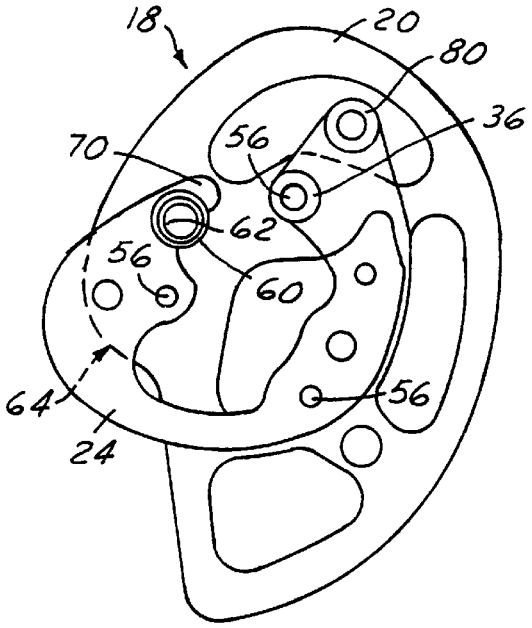
FIG. 5 is another side view of a cam assembly of the bow of FIG. 1 illustrating the opposite side from the side in FIG. 4.

As shown in FIGS. 2 and 4, three generally triangularly spaced apart screws 56 are used to interconnect the primary cams 20 and cam modules 24. This triangular spacing of the points of interconnection between the primary cams 20 and cam modules 24 more evenly distributes the forces throughout the cam assembly 18 to provide more robust cam assemblies 18. Further, the triangular interconnection permits accurate positioning of the cam module 24 and hence, the draw stop 80 and harness string hookup post 36 relative to the primary cam 20 without any cam module locator stop on the primary cam. Desirably, to ensure that the cam module 24 is firmly connected to the primary cam 20 adjacent to the harness spring hook-up post 36 whereat high stresses may develop when the bowstring 26 is drawn, one screw 56 preferably extends into a threaded hole in the harness string hook-up post 36. Similarly, one screw 56 preferably extends through the anchor 50 to which the bowstring is connected.

Figure 6:
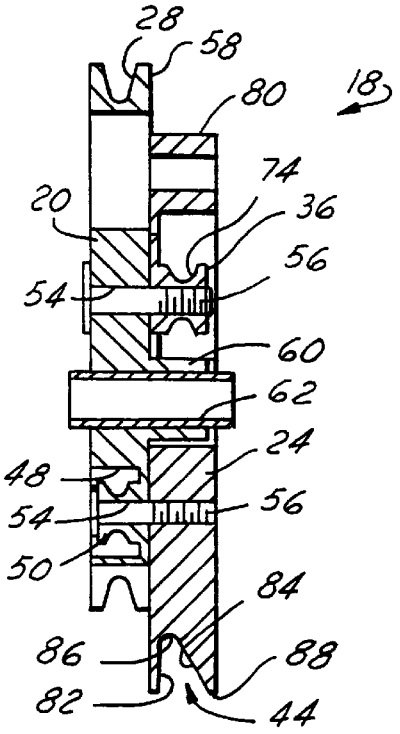
FIG. 6 is a sectional view of a cam assembly taken along line 6—6 of FIG. 4.
Figure 7:
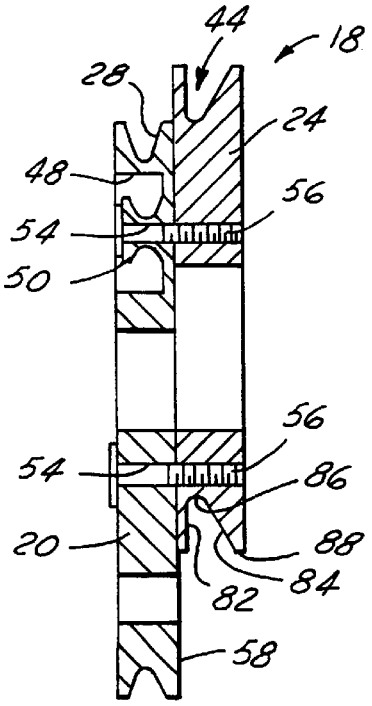
FIG. 7 is a sectional view of a cam assembly taken along line 7—7 of FIG. 4.
Figure 8:
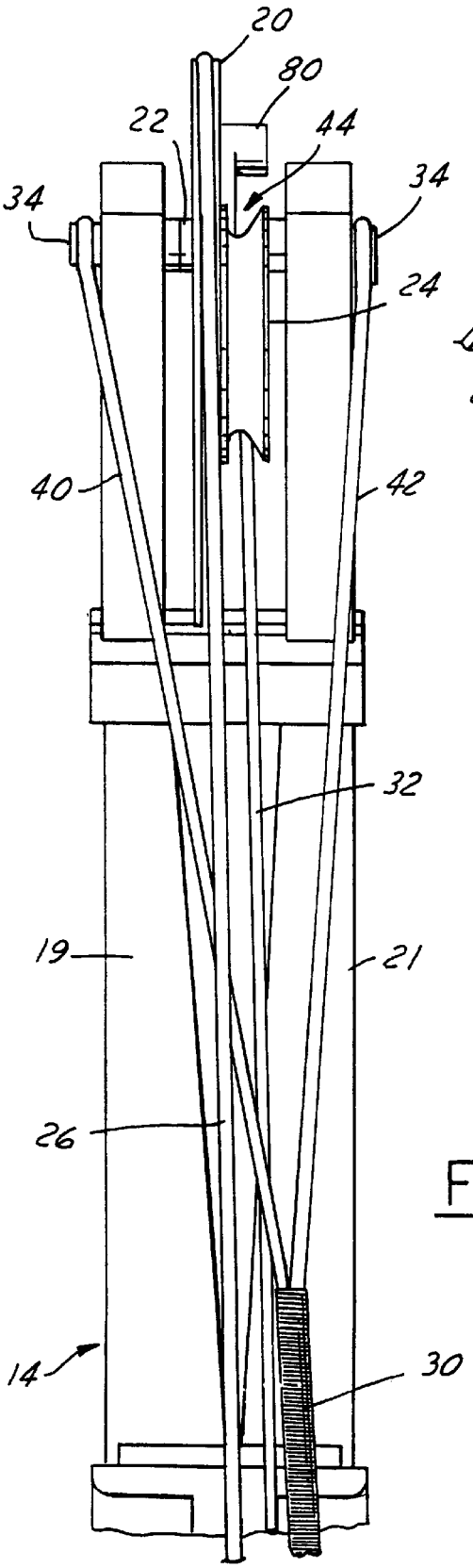
FIG. 8 is a fragmentary view illustrating the back of a cam assembly of the bow of FIG. 1.

Preferably, as shown in FIGS. 6 and 7, the track 44 of each cam module 24 has an inner surface 82 adjacent to the primary cam 20 and an outer surface 84 spaced from the inner surface 82. The outer surface 84 is preferably angled or inclined towards the inner surface 82 such that when the harness string 30,32 engages the outer surface 84, it may slide down to the bottom 86 of the track 44 greatly reducing the frictional engagement between the harness string 30,32 and the track 44 to provide a very smooth and steady draw of the bowstring 26. The outer surface 84 is preferably inclined at an angle at about 40° to 60° relative to the inner surface 82 which is substantially perpendicular to the axis of rotation of the cam assembly 18. Thus, the track 44 of each cam module 24 is wider adjacent its outer edge 88 than adjacent its bottom surface 86. Desirably, at its outer edge 88, the width of the track 44 of each cam module 24 is at least 3/16 of an inch and is more desirably, between about 3/16 of an inch to 5/16 of an inch and preferably about 1/4 of an inch. The wider tracks 44 with the inclined outer surface 84 greatly reduces the friction between the harness strings 30,32 and the cam modules 24 to drastically reduce wear on the harness strings 30,32 and thereby greatly extend their life in use.

There has thus been provided a compound archery bow 10 which provides an extremely efficient and repeatable performance of the bow 10 in use and greatly extends the service life of the bow 10. The integral draw stop 80 on the cam module 24 prevents over drawing of the bowstring 26 to consistently and efficiently repeatedly store the same quantity of energy in the bow 10 for easily repeatable, optimum performance of the bow 10. Providing the harness string hook-up post 36 on the cam module 24 as opposed to the primary cam 20 and providing the triangular attachment between the cam module 24 and primary cam 20 increases the stability and strength of the cam assemblies 18 in use, extends the life of the cam assemblies 18 and more efficiently stores energy in and releases energy from the bow 10 in use. The wider, sloped track 44 of the cam module 24 also improves the performance of a bow 10 by reducing frictional engagement between the harness strings 30,32 and the cam modules 24 to provide a smoother draw of the bowstring 26 and to reduce wear on the harness strings 30,32. Further, the radiused portion 64 of the primary cam 20 reduces the frictional engagement between the bowstring 26 and the primary cam 20 to greatly reduce wear of the bowstring 26 in use.

What is claimed is:

1. A cam assembly for a compound bow, the cam assembly comprising:

a primary cam being constructed to be connected to a limb of a bow and having a bowstring track formed therein constructed to receive a portion of a bowstring of the bow;

a secondary cam fixed to the primary cam and having a harness string track formed therein constructed to receive a portion of a harness string of the bow; and a draw stop integrally formed on the secondary cam and constructed to engage a portion of the bow to limit the maximum draw length of the bowstring of the bow.

2. The cam assembly of claim 1 wherein the draw stop is constructed to engage a harness string of the bow to limit the maximum draw length of the bowstring.

3. The cam assembly of claim 1 which also comprises a harness string hookup post on the secondary cam which is adapted to retain one end of a harness string in assembly of the bow.

4. The cam assembly of claim 3 wherein the draw stop of a cam assembly is adapted to engage the harness string connected to the same cam assembly.

5. The cam assembly of claim 1 wherein the secondary cam is fixed to the primary cam by three triangularly spaced screws.

6. The cam assembly of claim 5 which also comprises a harness string hookup post formed on the secondary cam and one of the screws extends into the harness string hookup post.

7. The cam assembly of claim 1 wherein the primary cam has a radiused portion adjacent to the point on the bowstring track where the bowstring separates from the bowstring track when the bow is in its at rest position.

8. The cam assembly of claim 7 wherein the radiused portion spans an arc of between 40° to 70° and has a radius of between 7.5 to 28 mm.

9. The cam assembly of claim 1 wherein the harness string track has an inner surface adjacent to the primary cam and an outer surface spaced from the inner surface and generally inclined towards the inner surface from an outer edge of the harness string track toward a bottom of the harness string track.

10. The cam assembly of claim 9 wherein the outer surface of the harness string track is generally inclined at an angle in the range of 40° to 60° relative to the inner surface of the harness string track.

11. The cam assembly of claim 9 wherein at its outer edge, the harness string track has a width of between 3/16 to 5/16 of an inch.

12. The cam assembly of claim 9 wherein the inner surface of the harness string track extends substantially perpendicular to the axis of rotation of the secondary cam and the outer surface of the harness string track is inclined at an acute included angle in the range of 40° to 60° to the inner surface of the harness string track.

13. A compound bow, comprising:

a riser having first and second ends;

a pair of limbs with one limb extending from each of the first and second riser ends and each limb having a free end;

a pair of primary cams with each primary cam adjacent the free end of a different limb and having a contoured track and a bowstring hookup post;

a bowstring attached at its ends to the bowstring hookup post of both primary cams and adapted to be received in the tracks of the primary cams, the bowstring may be drawn to flex the limbs and store potential energy in the bow and released to release that stored energy;

a pair of secondary cams with each secondary cam attached to a separate primary cam and having a contoured track, a draw stop and a harness string hook-up post; and a pair of harness strings with each harness string connected at one end to a limb and at its other end to a harness string hookup post of the secondary cam adjacent the other limb, the draw stop of at least one secondary cam is engageable with a harness string to limit the maximum draw length of the bowstring.

14. The compound bow of claim 13 wherein the track of each secondary cam has an inner surface and an outer surface spaced from the inner surface and inclined relative to the inner surface providing a track which is wider adjacent an outer edge than adjacent its bottom.

15. The compound bow of claim 14 wherein the outer surface of the track of the secondary cam is inclined at an angle of about 40° to 70° relative to the inner surface of the track of the secondary cam.

16. The compound bow of claim 13 wherein the draw stop on each secondary cam is integrally formed on the secondary cam.

17. The compound bow of claim 13 wherein each primary cam has a radiused portion at one end of its track adjacent to the point in the track wherein the bowstring separates from the track when the bow is in its at rest position.

18. The compound bow of claim 17 wherein the radiused portion of each primary cam spans an arc of about 40° to 70° and has a radius of about 7.5 to 28 mm.

19. The cam assembly of claim 13 wherein the inner surface of the harness string track extends substantially perpendicular to the axis of rotation of the secondary cam and the outer surface of the harness string track is inclined at an acute included angle in the range of 40° to 60° to the inner surface of the harness string track.

* * * * *